US006638189B2

(12) United States Patent
Chang

(10) Patent No.: US 6,638,189 B2
(45) Date of Patent: Oct. 28, 2003

(54) INFLATABLE GAME BALL AND METHOD OF MAKING SAME

(75) Inventor: I-Teh Chang, Hong Kong (CN)

(73) Assignee: Mei Huei Liu, Hong Kong (CN)

( * ) Notice: Subject to any disclaimer, the term of this patent is extended or adjusted under 35 U.S.C. 154(b) by 0 days.

(21) Appl. No.: 10/028,729

(22) Filed: Dec. 28, 2001

(65) Prior Publication Data

US 2003/0125141 A1 Jul. 3, 2003

(51) Int. Cl.[7] ..... A63B 41/10
(52) U.S. Cl. ..... 473/605; 473/602
(58) Field of Search ..... 473/598, 599, 473/603, 604, 605, 609, 601, 602

(56) References Cited

U.S. PATENT DOCUMENTS

| | | | | | |
|---|---|---|---|---|---|
| 2,623,747 | A | * | 12/1952 | Crowley | 473/605 |
| 2,627,892 | A | * | 2/1953 | Fenton | 156/147 |
| 2,789,821 | A | | 4/1957 | Crowley | |
| 2,945,693 | A | * | 7/1960 | Way | 473/605 |
| 3,948,518 | A | * | 4/1976 | Tebbetts, Jr. | 473/605 |
| 4,191,375 | A | | 3/1980 | Uruba et al. | |
| 4,606,544 | A | | 8/1986 | Olazabal, Jr. | |
| 4,853,057 | A | * | 8/1989 | Hoffmann | 156/147 |
| 5,597,432 | A | | 1/1997 | Shishido et al. | |
| 5,772,545 | A | | 6/1998 | Ou | |
| 6,039,662 | A | | 3/2000 | Chan | |
| 6,099,423 | A | | 8/2000 | Ou | |
| 6,206,795 | B1 | | 3/2001 | Ou | |
| 6,220,979 | B1 | | 4/2001 | Chan | |

* cited by examiner

*Primary Examiner*—Kien T. Nguyen
(74) *Attorney, Agent, or Firm*—Burns, Doane, Swecker & Mathis, L.L.P.

(57) ABSTRACT

A sports or games balls having an inflatable bladder in which the bladder is re-inforced by a plurality of cloth (or other woven materials) pieces which are adhered to the bladder surface in a substantially orthogonal manner. The cloth-wrapped bladder is heat treated within a mould assembly to strengthen the glue bonding between the cloth pieces and the bladder surfaces and to provide a bladder with a well-defined shaped.

13 Claims, 4 Drawing Sheets

TOP VIEW
FRONT VIEW
1
2
3
4
5
6
7
8
9
10
11
12
13/15
14/16
13/14
15/16
17
18
19
20
21
22
23
24

INFLATABLE GAME BALL AND METHOD OF MAKING SAME

FIELD OF THE INVENTION

The present invention relates to games or sports balls and, more particularly, to game or sport balls with an inflatable bladder. More specifically, although not solely limiting thereto, this invention relates to games or sports balls having a cloth, or more generally, woven material, wrapped inflatable bladder. This invention also relates to methods of making game or sport balls and an inflatable bladder therefor.

BACKGROUND OF THE INVENTION

Many sports or games balls include an inner body of an inflatable bladder and an outer body enclosing the bladder. The outer body is generally made up of an assembly of flexible panels which are usually made, for example, of leather, synthetic leather such as polyurethane (PU) or polyvinyl chloride (PVC) or other durable materials. The panels are generally joined together by hand or machine sewing or by adhering them onto the bladder carcass according to standard or conventional shapes and patterns.

For example, a conventional basketball comprises eight leaf-shaped panels which are affixed onto a bladder carcass having a plurality of protruding ribs which together define the perimeters of the leaf-shaped panels. For a conventional soccer ball, the outer body is made of an assembly of panels comprising twelve pentagonal panels and twenty hexagonal panels by edge-to-edge sewing. The outer body of a conventional volleyball consists of eighteen rectangular panels assembled by edge-to-edge sewing.

In general, the outer body of a sports or games ball provides a definitive size, pattern, shape and configuration characterizing the type of sport the ball is primarily designed for. On the other hand, it is also the function of the outer body to provide permanence of shape and to maintain the overall shape and dimensions when the ball is subject to a range of inflation pressures. In addition, the rigidity and durability of a conventional sports ball may primarily depend on the outer body. Thus, the outer body must be designed and made to withstand and absorb all the impact forces which can be expected during the normal course of the sport for which the ball is designed.

The inner body of a conventional sports ball generally includes an inflatable bladder which usually has a valve stem for air inflation and deflation. In general, when air is pumped into the inflatable bladder, the pressurized air inflates the bladder which in turn causes the outer body to expand and attain an overall shape as defined by the design and structure of the outer body.

At the same time, the tension on the outer body due to inflation of the inner body gives the sports ball the necessary bouncing characteristics. Hence, it is generally understood that the structural integrity of a conventional sports ball depends largely, if not solely, on the outer body rather than the inner inflatable bladder. As a result, the quality and strength of the constituting outer panels as well as their sewing and the sewing linings is generally regarded as directly affecting the quality and durability of a sports ball.

To withstand high and repetitive impact forces and to provide high durability, the outer bodies are usually made of thick and, usually cushioned, panels. This makes even sewing or stitching more difficult and stringent quality control is required. As a result, yielding will be low with a high reject rate. In addition, parts of the stitching or sewing may be damaged as a result of repeated localized hitting on a ball. As a result, localized weakness may appear on the outer body. When the sports ball is inflated or over-inflated, the pressurized air will be most apparent at such weak points and may cause adverse deformation of the overall shape of the ball. Such deformation may result in un-predictable bouncing orientation or characteristics of the ball when hit or may even cause the ball to burst at or through the weaker portions when subject to heavy impact.

In order to relieve the outer body from bearing the sole responsibility of fulfilling all he afore-mentioned functions of a conventional outer body of a sports ball, there have been proposals to employ a re-inforced inflatable bladder within the outer body of a game ball instead of the conventional bladder which is made from a single layer of thin rubber sheet. A natural consequence of the use of such an re-inforced bladder is that a less stringent quality demand can be placed on the design and making of the outer body, thereby also reducing manufacturing rejects and costs in favour of consumers.

For example, in U.S. Pat. No. 2,789,821, there is disclosed a sports ball having an inflatable bladder which is wrapped within a winding of synthetic cord or thread. In that construction, an inflated bladder is firstly applied with fabric tapes which are applied circumferentially on orthogonal planes on the surface of an inflated bladder and passing through the valve stem in order to limit the expansion of the bladder in the two planes of the circles. The taped bladder is then covered with a winding of threads for re-inforcement.

In U.S. Pat. No. 5,772,545 and U.S. Pat. No. 6,220,979, there are disclosed sports balls having a wound-core covered with windings of thread, such as nylon yarn, in order to enhance durability and to resist enlargement of the game ball over time.

However, re-inforcing a soft-bladder by thread-winding is a tedious process which requires a large length of thread as well as a large number of windings. In addition, such thread-wound inflatable bladders tend to be more rigid and less user-friendly. Also, a thread-wound inflatable bladder is usually very light and additional weight must be added to the outer body in order to attain the necessary overall weight in order to meet product standards or specifications. This will add to costs and is therefore less attractive. Furthermore, when thread winding is applied on the bladder, it will usually follow the bladder's original unwound shape and size. If the shape and/or size of the original unwound bladder is not correct, the wound bladder will remain permanently in its incorrect size and shape.

Hence, it will be highly advantageous if there can be provided relatively simple and inexpensive methods for making games or sports balls with a re-inforced inflatable bladder while alleviating the shortcomings associated with the thread-wound bladders. In other words, it will be highly desirable if the known benefits of a re-inforced inflatable bladder can be attained by forming a reinforced bladder using a relatively simple and inexpensive method. In one respect, it will be highly advantageous if the improved method for making an re-inforced bladder can be utilized to form an inflatable bladder having a size which is substantially restricted by the reinforcement when inflated with a range of air pressure which can be expected from an ordinary pumping device for sports balls. At the same time, it will also be of great general advantage if such bladders will maintain a reasonable and even degree of flexibility in most orientations of the bladder and also retains the expected bouncing characteristic of an inflatable bladder.

OBJECT OF THE INVENTION

Hence, it is an object of the present invention to provide methods for making game balls and re-inforced inflatable bladders for game balls in which the inflatable bladders are re-inforced by relatively simple means and methods so that a durable inflatable bladder can be obtained without compromising the beneficial characteristics of an inflatable bladder.

In one aspect, such an re-inforced inflatable bladder would have a size and shape which is substantially restrained by the re-inforcement when subject to an expected range of pumping air pressure while at the same time maintaining a high and even degree of flexibility.

It is another object of the present invention to provide a substantial re-inforced inflatable bladder wherein the weight of the bladder can be relatively easily adjusted by the choice of the re-inforcing materials in order to meet the general weight requirements while substantially retaining the bouncing characteristics of conventional sports balls. As a minimum, it is an object of the present invention to provide the public with a choice of sports balls having an improved type of re-inforced inflatable bladder and methods of making the same.

In general, it is an object of the present invention to provide an improved inflatable bladder for sports- or games-balls having an outer body formed generally with a plurality of panels sewn together in which the enhanced characteristics of the inflatable bladder lessens the demand of quality are robustness on the outer body.

SUMMARY OF THE INVENTION

According to the present invention, there is provided a method of making a sports- or games-ball having an inflatable bladder including the steps of:

- inflating said bladder until the surface of said bladder is generally under tension,
- adhering a plurality of woven material pieces to the outer surface of said inflated bladder,
- moistening said woven material wrapped inflated bladder,
- placing said woven material wrapped and inflated bladder inside a mould,
- further inflating said woven material wrapped bladder to a pre-determined pressure until said bladder presses against said mould,
- apply heat to said woven material wrapped and inflated bladder inside said mould to strengthen the bonding between said bladder and said cloth pieces.

According to another aspect of the present invention, there is provided a method of making an inflatable bladder of a ball by applying a plurality of cloth- or woven-material patch pairs onto the surface of said inflatable bladder, where at least some of said pairs of patches are disposed in a diametrically opposite manner on the surface of said bladder.

According to yet another aspect of the present invention, there is provided a ball having a hollow inflatable bladder, wherein said bladder includes a plurality of cross-shaped cloth pieces disposed substantially at the diametrically opposite ends of said bladder and said bladder is enclosed within an outer body made from a plurality of panels sewn together.

According to a fourth aspect of the present invention, there is provided a ball having a hollow inflatable bladder, wherein said bladder further includes a plurality of overlapping cross-shaped cloth pieces disposed on the surface of said bladder.

Preferably, the woven material-wrapped and bonded bladder is made into the shape of said mould.

Preferably, at least some of said plurality of woven-material pieces are adhered in pairs of pieces on orthogonal planes.

Preferably, the said method further including the steps of deflating said bladder and, removing said bladder from said mould.

Preferably, at least some of said woven-material pieces are pre-treated with a water-soluble adhesive before adhering to said inflatable bladder.

Preferably, at least some portion of said woven-material pieces overlap with adjacent woven-material pieces, the woven material is a cloth material woven from synthetic yarn.

More preferably said synthetic yarn comprises fibre-glass or polyester yarn.

Preferably, the plurality of woven-material pieces are adhered to said inflatable bladder in the following manner:

- forming a first woven-material patch at one pole of said inflated bladder and surrounding the air-inlet valve of said bladder, wherein said pole coincides with the location of said valve,
- forming a second woven-material patch at the opposite pole of said inflated bladder, wherein said opposite pole is located diametrically opposite said valve,
- joining said first and second woven-material patches by a plurality of longitudinally extending cloth pieces to form a first and a second circumferential of woven-material wrapping on said inflated bladder,
- adhering a plurality of latitudinal running cloth pieces along the equator of said inflated bladder until the equator of said inflated bladder until the equator of said inflated bladder is substantially covered by woven material,
- applying further cloth pieces until the exposed portion of said inflated bladder is substantially covered by woven-material pieces.

Preferably, the woven-material patches surrounding said poles forms a cross or square shape.

Preferably, the longitudinally extending woven material pieces join said first and second polar patches by connecting the corresponding salient part of said polar patches.

Preferably, the first and second polar of patches are joined by at least four latitudinal running woven material pieces.

Preferably, the bladder includes a plurality of cloth- or woven- material patch pairs bonded onto the surface of said inflatable bladder, wherein at least some of said pairs of patches are disposed in a diametrically opposite manner on the surface of said bladder.

Preferably, the bladder is enclosed within an outer body made of a plurality of sewn panels.

Preferably, the inflatable bladder includes a plurality of cross-shaped cloth pieces pairs disposed substantially at the diametrically opposite ends of said bladder.

Preferably, the inflatable bladder is substantially covered by a plurality of woven material patches with overlapping of adjacent patches.

BRIEF DESCRIPTION OF THE DRAWINGS

The present invention will now be explained in further details by way of examples and with reference to the accompanying drawings, in which.

DETAILED DESCRIPTION OF THE PREFERRED EMBODIMENTS

Figure 1:
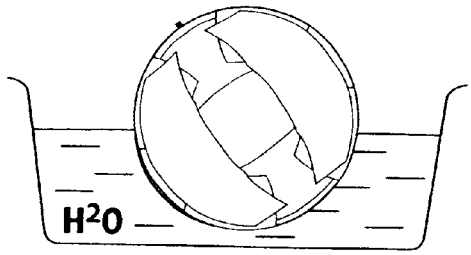
FIG. 1 illustrates the moistening of a cloth-wrapped bladder after an inflatable bladder has been covered with cloth-pieces and before the adhered cloth pieces are heat treated.

Referring to the Figures, there are shown examples illustrating the preferred steps and procedures for making or forming a re-inforced bladder of the present invention. Turning firstly to FIG. 1, there is shown an inflated rubber bladder which is being moistened by dipping into a water bath. The bladder is already enclosed within a wrapping of cloth pieces which are adhered to the surfaces of the bladder by, for example, the methods to be described below. Of course, the cloth-wrapped bladder can also be moistened by mist or steam spraying onto the bladder surface.

Figure 2:
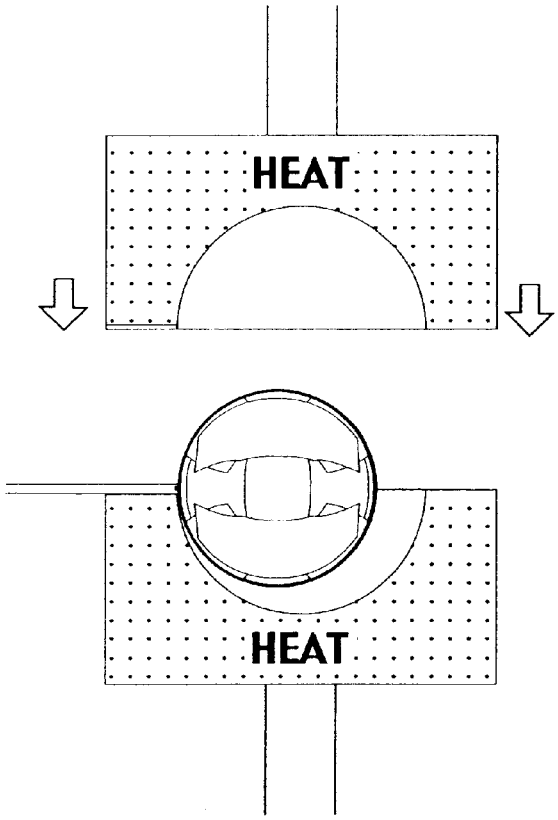
FIG. 2 illustrates the step when the inflatable bladder of FIG. 1 is being placed in a shape-forming mould for subsequent heating and setting.

In the next step, the moistened bladder is placed within the hollow chamber of a mould with its valve stem connected to the outside through a hollow tube or cavity extending beyond the mould as shown in FIG. 2.

Figure 3:
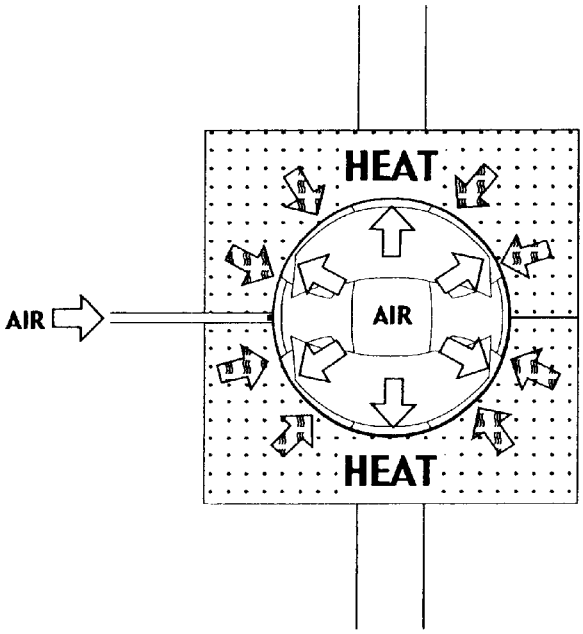
FIG. 3 illustrates the step in which the inflatable bladder of FIG. 2 is being subject to additional pressurized air and heat treatment within the mould.

Referring to FIG. 3, after the mould has been assembled, the bladder is inflated with pressurized air through the hollow tube so that it expands with its outer wrapped surface pressing against the internal wall of the mould. The pressure from the inflated bladder against the interior surfaces of the mould causes a back reaction pressure from the mould surface to press against the moistened cloth wrapping.

At this stage, heat is applied to the mould to cause setting of the glued cloth pieces which are wrapped on the bladder surface. Since the cloth pieces have been pretreated with a water-soluble glue, the heat and steam generated by the mould will enhance the bonding between the cloth pieces and the bladder surface. Furthermore, the steam generated by the heated mould due to contact with the moistened bladder also help to improve the evenness of the cloth-bladder bonding.

Figure 4:
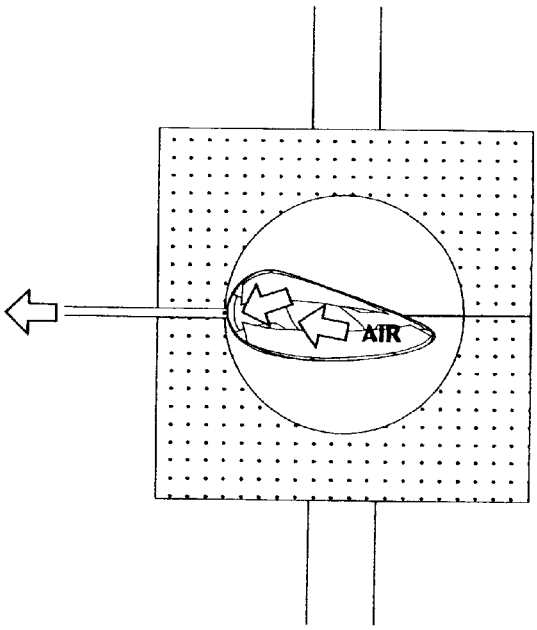
FIG. 4 illustrates the step in which the inflatable bladder of FIG. 3 is being deflated.
Figure 5:
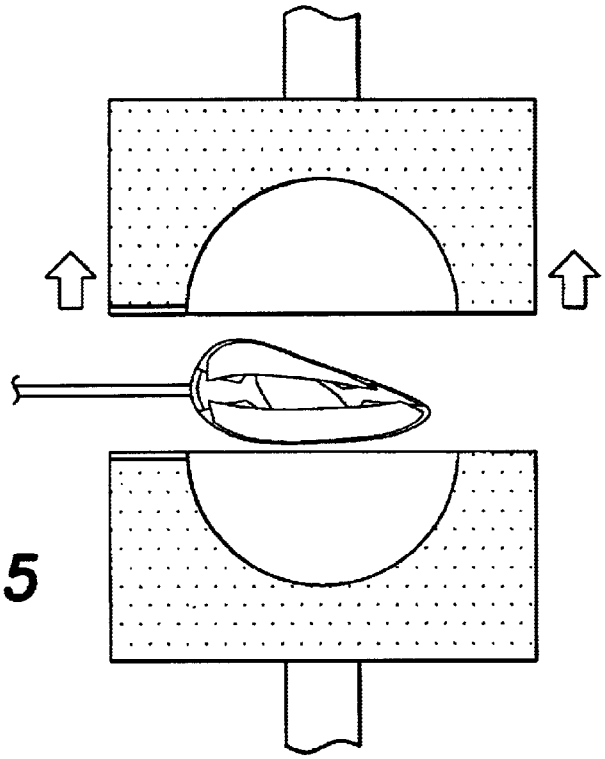
FIG. 5 illustrates the step in which the mould pieces are being separated and the deflated bladder is being removed from the mould.
Figure 6:
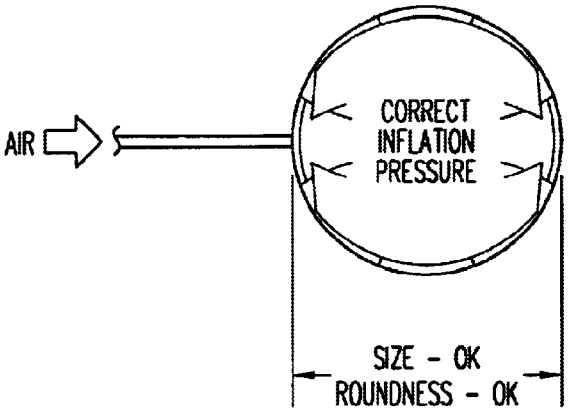
FIG. 6 shows the step in which the heat-treatment inflatable bladder from FIG. 5 above is inflated.

Referring now to FIGS. 4 and 5, after the cloth-wrapped bladder has been heat treated so that the pre-applied adhesive means is adequately bonded to the inflated bladder, the bladder can be deflated and removed from the mould. After the removal, the bladder is inflated to a pre-determined pressure to access the shape and size for product quality control.

Referring to FIGS. 8 to 13, there are shown an example of the preferred steps or procedures for preparing a cloth-wrapped re-inforced bladder of the present invention.

Figure 7:
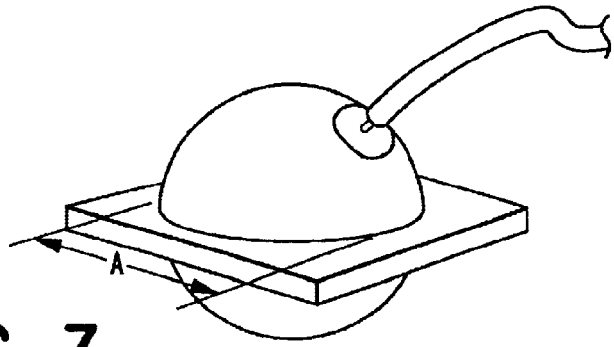
FIG. 7 shows a fixture device in which an inflatable bladder can be inflated to prepare for the cloth-wrapping.
Figures 8, 9, 10, 11, 12, 13:
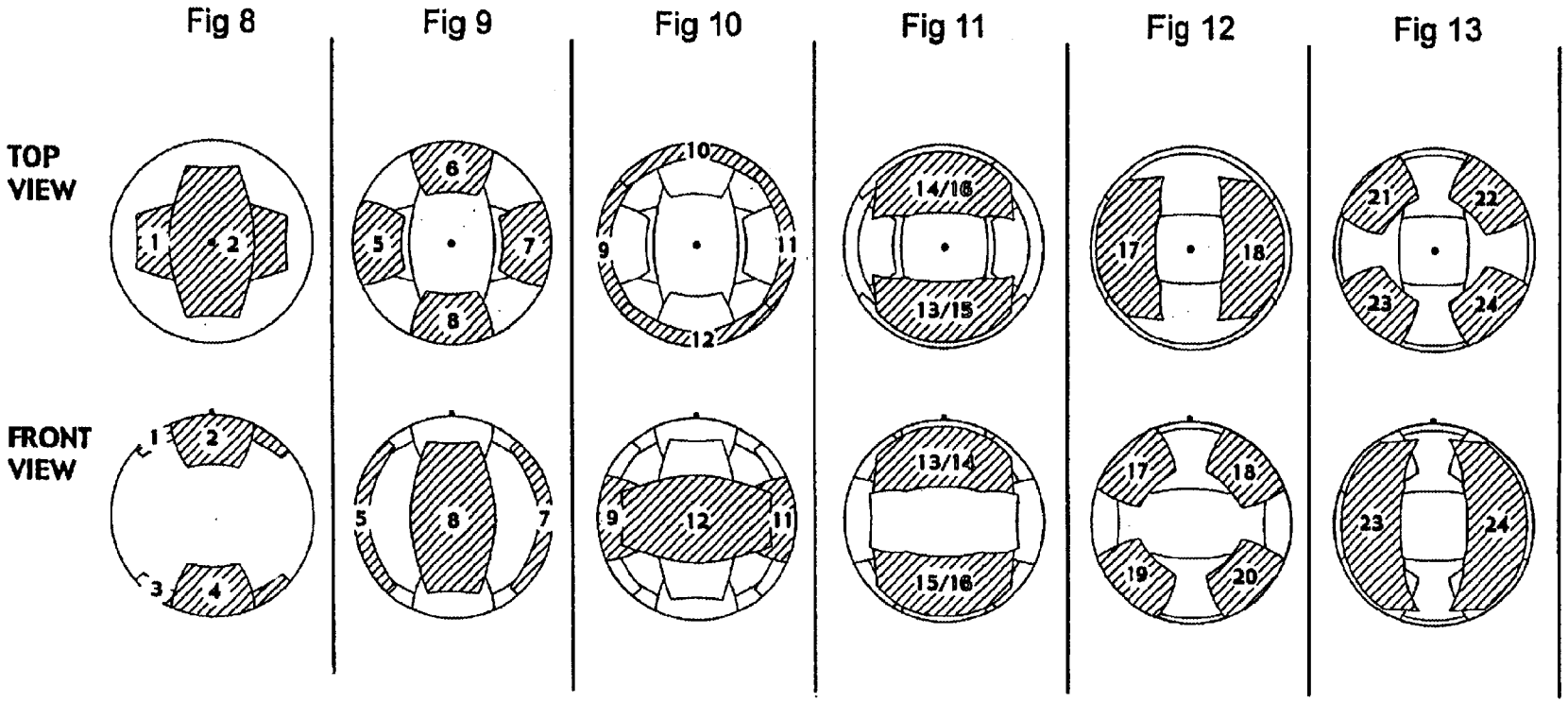
FIG. 8 to FIG. 13 show the preferred procedures for wrapping an inflatable bladder with cloth pieces.

Referring firstly to FIG. 7, a conventional rubber bladder made for example of rubber, latex of similar materials, is inflated to a pre-determined size. For manufacturing convenience, the appropriate starting size of the inflated bladder is measured and controlled by reference to an aperture formed on a fixture. In the present preferred example, this fixture is a board having a pre-defined aperture. As shown in FIG. 8, after the bladder has been inflated to an appropriate pressure and size, a first cloth patch (1, 2) is applied on one (the valve) pole of the bladder so that the valve stem is roughly located at the middle of the first cloth patch as shown in FIG. 8. This first cloth patch (1,2) preferably has a cross shape with four substantially orthogonal protruding arms. A second cloth patch (3, 4) which has substantially the same shape as the first cloth patch (1, 2) is then adhered to the opposite pole which is located substantially diametrically opposite the valve stem. The first and second cloth patches are preferably aligned so that the orthogonal projection of the first patch (1, 2) coincides with that of the second patch (1, 2). Referring to FIG. 9, a plurality of longitudinally running cloth pieces (5, 6, 7 and 8) are then adhered on the bladder surface joining the first and the second cloth patches (1, 2, 3 and 4). The ends of the cloth pieces (5, 6, 7 and 8) are respectively adhered to the protruding portions of the first and second cloth patches with some overlap at their end portions.

After four pieces of longitudinally running cloth pieces have been adhered to the bladder in the afore-mentioned manner, two circumferential strips (2, 6, 4 and 8) and (1, 5, 3, and 7) having orthogonal planes to each other are then formed on the bladder surface.

The next step is to form a ring of cloth pieces surrounding the equator of the bladder as shown in FIG. 10. Referring to FIG. 10, the latitudinal running cloth pieces (9, 10, 11 and 12) are adhered onto the surface of the inflated bladder along the equator and covering the middle portions of the four longitudinal running pieces (5, 6, 7 and 8). Next, the still exposed portions of the bladder are covered by latitudinal running cloth pieces (13, 14, 15 and 16) so that the upper and lower semi-hemispheres not already covered are substantially covered by cloth pieces, as shown in FIG. 11.

Referring to FIG. 12, the latitudinal running cloth pieces applied in the last step of FIG. 12 are further joined by latitudinal running pieces (17, 18, 19 and 20) to further enhance the wrapping strength.

Finally, as shown in FIG. 13, four additional longitudinally running cloth pieces are adhered to the bladder at the area which are not covered by the four longitudinally running pieces adhered in the step of FIG. 10. With the completion of these wrapping procedures, a comprehensively cloth-wrapped bladder has been formed and the next step is to re-inforce the bonding between the cloth wrapping and the inflatable bladder to provide the necessary strength and durability. It will be observed that many orthogonal running cloth pieces (or cloth patches having a cross-shape) have been adhered to the inflatable bladder and many portions of the bladder are covered with double layers of cloth wrapping after the procedures. The preferred re-inforcement can be done for example by following the steps described above with reference to FIGS. 1 to 6.

After the bladder has been made, it can be inserted into an outer body which is preferably made of a durable material to complete the manufacture of a sports ball. The outer body may be formed by conventional hand- or machine-sewing methods, in which an assembly of panels are sewn together and the bladder is enclosed therein, or other suitable methods such as laminating. Because of the characteristics of the enhanced inflatable bladder, a lesser stringer demand is placed on the outer body and sports balls can be made more cost effectively without comprising its quality.

While the present invention has been explained by reference to a preferred method of cloth-wrapping an inflatable bladder and a preferred method for strengthening the bonding between the cloth-wrapping and the inflatable bladder, it will be appreciated by persons skilled in the art that trivial or common sense modifications can be made or applied to attain the purposes described in the present specification and claims without following the entire steps or procedures described herein but such modifications are naturally within the scope and spirit of the present invention.

Furthermore, while the present invention has been explained by reference to cloth or cloth pieces, it should be appreciated that the term cloth in the present context includes all appropriate woven materials, including fabrics woven from fibre glass yarn, polyester yam or other synthetic fibres. Hence, the terms "cloth" and "woven material" should be construed as equivalent or interchangeable to the extent which is appropriate for the context.

Thus, it will be obvious to persons skilled in the art that the scope and spirit of the present invention will be construed according to the description herein by reference to the drawings and with consideration of the state of the art technology as well as common general knowledge.

In particular, the first and second cloth patches described herein do not necessarily need to be of the specific shape and construction as described above. For example, the first and second patches can be replaced by cloth patches having a rectangular, circular or other similar shapes. In one aspect, it will be appreciated that the present invention includes the proposed method of reinforcing an inflatable bladder by applying a plurality of cloth- or woven-patches pairs onto a bladder wherein at least some of the patch-pairs are disposed in a substantially diametrically opposite manner. More specifically, at least one of the cloth- or woven-patch pairs will have a patch surrounding the valve stem of the inflatable stem.

In general, the cloth patches are under orthogonal tension when bonded to the inflatable bladder which tension tend to maintain the bladder in the desirable shape. Thus, a bladder of the present invention will be characterised by a plurality of orthogonally tensioned cloth patches bonded on its surface. The tensioned cloth patches are preferably disposed in diametrically opposite pairs.

Furthermore, while some portions of the inflatable bladder are covered with a double layer of overlapping cloth-portions, it should be appreciated that this is merely to enhance the strength, durability as well as the weight of the inflatable bladder and can be modified by using more or less cloth layers as and when necessary. It is preferred although not essential that a majority of the outer surface of the bladder is covered. Hence, it will be appreciated by persons skilled in the art that trivial modifications or variations made in light of the common general knowledge would not depart from the scope and spirit of this invention which should be understood by reference to the present specification and the prevailing general knowledge.

What is claimed is:

1. A ball including an inflatable bladder and an outer sewn cover, said inflatable bladder being covered by at least a first and a second alternate fabric layers, said first fabric layer includes a plurality of longitudinally extending fabric strips which partially cover the surface of said inflatable bladder, said second fabric layer includes a plurality of latitudinally extending fabric strips, said second fabric layer includes an equatorial fabric strip surrounding the equator of said inflatable bladder and at least a first and a second latitudinal strips, said equatorial strip being generally parallel to and intermediate of said first and said second latitudinal strips.

2. A ball according to claim 1, wherein said first and second latitudinal strips are generally equidistant from said equatorial strip.

3. A ball according to claim 1, wherein said inflatable bladder includes a third fabric layer, said third fabric layer includes a plurality of longitudinally extending fabric strips which collectively cover part of the surface of said inflatable bladder, said second fabric layer being intermediate of said first and said third fabric layer.

4. A ball according to claim 1, wherein said inflatable bladder does not have a threaded layer generally surrounding said inflatable bladder.

5. A ball according to claim 1, wherein said inflatable bladder is placed inside said outer sewn cover by insertion.

6. A ball according to claim 5, wherein said second fabric layer is immediately adjacent to said outer sewn cover.

7. A ball according to claim 6, wherein said second fabric layer is non-adhered to said outer sewn cover.

8. A ball including a bladder and an outer sewn cover, said bladder being covered with a first fabric layer, a second fabric layer and a third fabric layer, said second fabric layer being intermediate of said first and said third fabric layers, wherein:

said first fabric layer partially covers said bladder and includes a first and a second meridian strips, said first and second meridian strips respectively define a first and a second meridian planes which are generally orthogonal to each other;

said second fabric layer includes an equatorial strip, a first latitudinal strip and a second latitudinal strip, said first and second latitudinal strips being generally parallel to said equatorial strip and said equatorial strip being intermediate of said first and second latitudinal strips, said equatorial and latitudinal strips intersect both said first and second meridian strips of said first fabric layer;

said third fabric layer partially covers said bladder and includes a third and a fourth meridian strips, said third and fourth meridian strips define a third and a fourth meridian planes which are generally orthogonal to each other, said third and fourth meridian strips generally cover the surface of said bladder not already covered by said first and said second meridian strips.

9. A ball according to claim 8, wherein said second fabric layer substantially covers the surface of said bladder generally left uncovered by said first fabric layer.

10. A ball according to claim 9, wherein said second fabric layer substantially covers the surface of said bladder generally left uncovered by said third fabric layer.

11. A ball according to claim 8, wherein said first fabric layer is immediately adjacent to said bladder, said first and said second meridian strips include a first and a second strip which cross, with the centers of the crosses disposed at the opposite poles of said bladder, said first and said second meridian strips being formed by interconnecting the salient ends of said first and said second crosses.

12. A ball according to claim 11, wherein said third and said fourth meridian strips of said third fabric layer intersect said polar strip crosses at the junctions between said salient ends.

13. A ball according to claim 11, wherein each of said first and said second strip crosses are a right cross comprising two arms of equal length.

* * * * *